United States Patent [19]

Prochaska

[11] 4,171,117

[45] Oct. 16, 1979

[54] MANUALLY ADJUSTABLE PICTURE HANGER

[76] Inventor: John J. Prochaska, 316 Oswego, Park Forest, Ill. 60466

[21] Appl. No.: 894,733

[22] Filed: Apr. 10, 1978

[51] Int. Cl.[2] ..... A47G 1/24

[52] U.S. Cl. ..... 248/495

[58] Field of Search ..... 248/201, 476, 489, 495, 248/496, 497, 498

[56] References Cited

U.S. PATENT DOCUMENTS

| | | | |
|---|---|---|---|
| 999,961 | 8/1911 | Colas | 248/496 X |
| 1,600,919 | 9/1926 | Baalsrud et al. | 248/496 |
| 2,262,287 | 11/1941 | Johnson | 248/496 |
| 2,791,055 | 5/1957 | Scheyer | 248/497 X |
| 3,265,339 | 8/1966 | Hushek | 248/495 |
| 3,791,709 | 2/1974 | Cross | 248/496 X |

FOREIGN PATENT DOCUMENTS

| | | | |
|---|---|---|---|
| 781317 | 3/1968 | Canada | 248/497 |
| 293944 | 7/1928 | United Kingdom | 248/495 |
| 1220412 | 1/1971 | United Kingdom | 248/495 |

*Primary Examiner*—William H. Schultz

*Attorney, Agent, or Firm*—Michael G. Berkman

[57] ABSTRACT

A manually adjustable picture hanger for hanging a picture frame in a stable level attitude. Three embodiments are described, each of which includes a flat bracket means, a first pointed probe extending through a channel formed in the bracket means, and a second pointed probe extending through an opening in the bracket means. Manual force applied to the picture frame pivots the bracket means about the second probe for adjustment to a preselected level attitude. The frame is retained in a stable position by frictional abutment between the first and second probes, the bracket means, and the frame.

8 Claims, 12 Drawing Figures

MANUALLY ADJUSTABLE PICTURE HANGER

BACKGROUND OF THE INVENTION

The present invention relates to hangers used for positioning picture frames on the walls of homes.

Numerous devices for positioning picture frames are known in the prior art. However, each of the prior art devices suffers from one or more serious disadvantages making it less than completely suitable for its intended purpose. For example, one of the most widely used devices for hanging pictures comprises a metal wire fastened to the rear of a frame, and suspended from brackets secured to a wall. This device suffers from the disadvantage of being too readily displaced from its desired position.

Other devices for hanging pictures are based upon various combinations of screws threaded through brackets. These devices require a great deal of time to assemble properly and to adjust, and they are more complex and therefore more expensive than the hanger of the present invention.

It is a principal object of the present invention to provide a manually adjustable picture hanger that is relatively simple to attach to a picture frame and to adjust in a level attitude, while being resistant to inadvertent shifting once placed in its desired position.

The foregoing objectives are accomplished by providing a picture hanger including a pair of probes attached to a wall and positively engaging internal edge portions of openings in a bracket affixed to a picture frame, thereby stabilizing the frame against inadvertent shifting.

These and other objects and advantages of the invention will become apparent to persons skilled in the art from the following specification, taken in conjunction with the drawings.

BRIEF DESCRIPTION OF PREFERRED EMBODIMENTS

Figure 1:
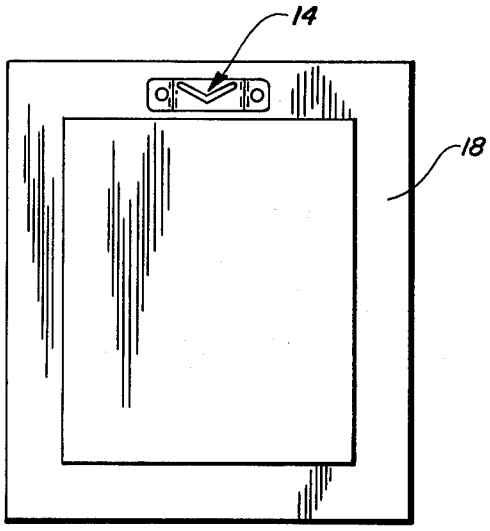
FIG. 1 is a rear elevational view of a picture frame, including a first embodiment of the hanger of the invention.
Figure 2:
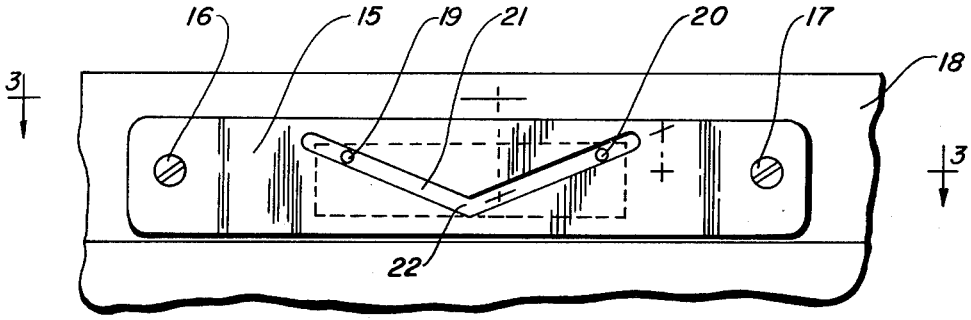
FIG. 2 is an enlarged fragmentary view of the picture frame of FIG. 1, showing the hanger in greater detail.

A first embodiment of a manually adjustable picture hanger 14 of the invention is shown in FIGS. 1–4. This first embodiment includes a bracket means comprising a single metal bracket 15, two screws 16, 17 for securing the bracket 15 to a rear portion of a picture frame 18, and a first pointed probe 19 and a second pointed probe 20 joined together by a bight or flange 21 extending between forward extremities of the probes 19,20.

Figure 4:
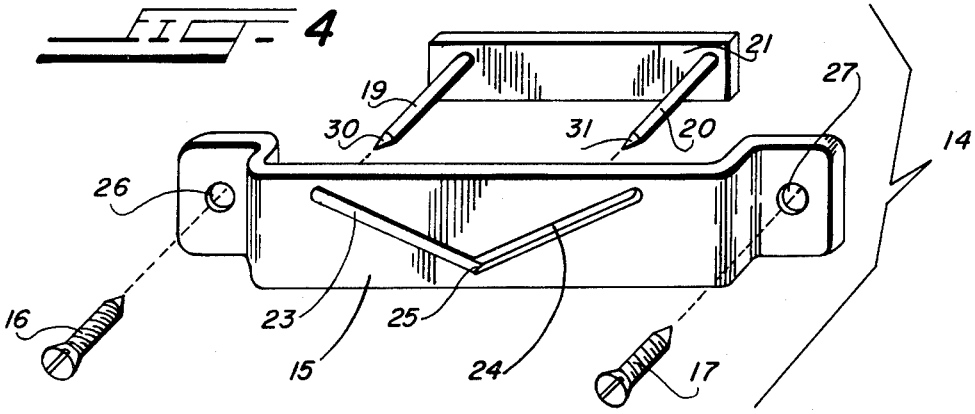
FIG. 4 is an exploded rear perspective view of the hanger of FIGS. 1–3.
Figure 5:
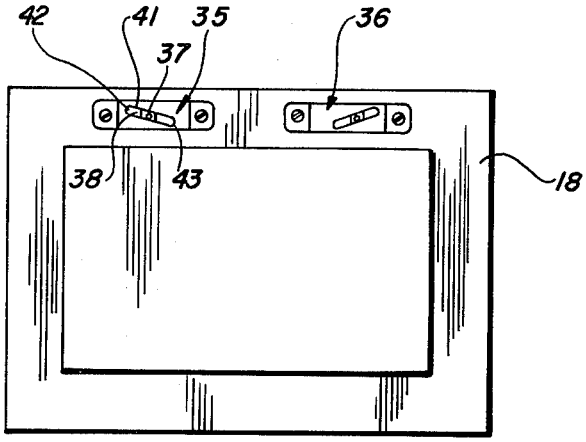
FIG. 5 is a rear elevational view of a picture frame, including a second embodiment of the invention comprising a pair of hangers.
Figure 6:
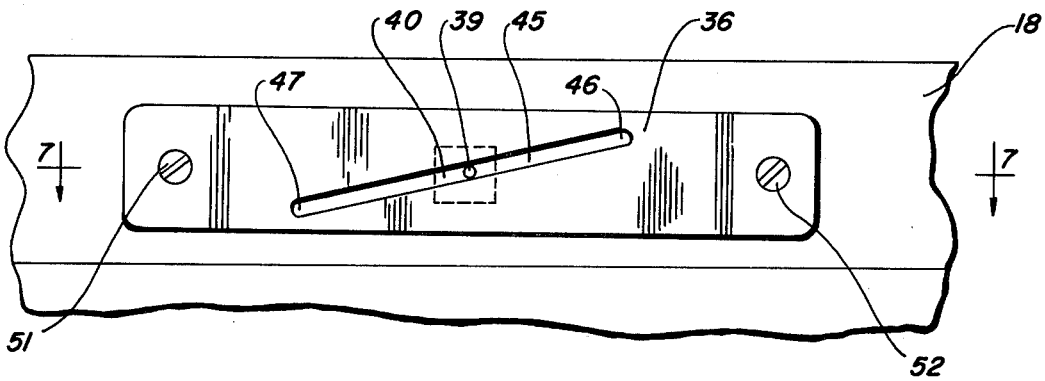
FIG. 6 is an enlarged fragmentary view of the picture frame of FIG. 5, showing in greater detail one hanger of the pair of hangers.

The metal bracket 15 defines a generally V-shaped opening or channel 22 including a first elongated channel 23 and a second elongated channel or opening 24. The two channels 23,24 have a common center terminus 25, as shown in FIG. 4. Screws 16, 17 are inserted through lateral apertures 26, 27 in the bracket 15 for affixation to the frame 18.

The bracket 15 is screwed to a rear portion of the frame 18 with a shank portion of the first probe 19 inserted through the channel 23, a shank portion of the second probe 20 inserted through the opening 24, and the bight 21 squeezed in frictional abutment between a rear surface portion 28 of the frame 18 and a forward surface portion 29 of the bracket 15.

Figure 3:
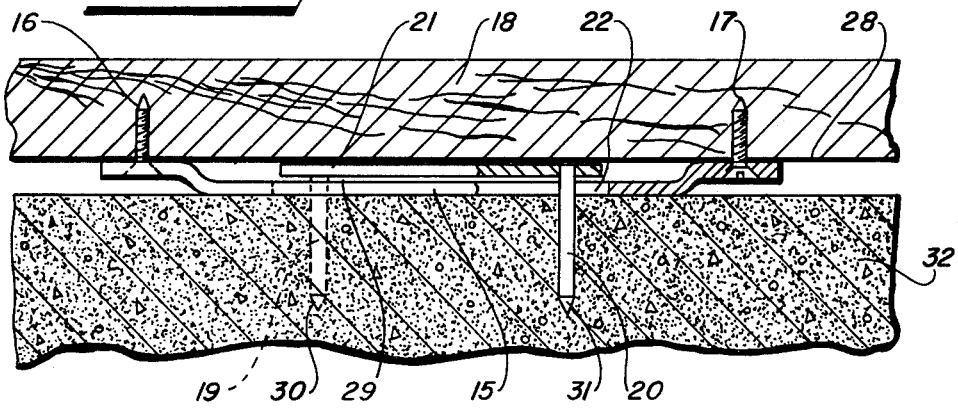
FIG. 3 is a top cross-sectional view, taken along the lines 3—3 of FIG. 2.

Force is applied to the frame 18 with pointed rearward end portions 30, 31 of the probes or nails 19, 20 facing a wall 32, so that the probes 19, 20 are imbedded in the wall 32, as shown in FIG. 3. In this position force applied rotationally to the frame 18 adjusts the frame 18 into a stable, level attitude. Shank portions of the probes 19, 20 are in positive engagement with lower edge portions of the bracket 15 facing the channel 23 and opening 24. Friction between the bight 21 and frame 18 also stabilizes the frame 18 against inadvertent shifting.

A second embodiment of a manually adjustable picture hanger 34 of the invention is shown in FIGS. 5–8. This second embodiment 34 comprises bracket means comprising a first metal bracket 35 and a second metal bracket 36, a first pointed metal probe 37 including a laterally outwardly extending first flange 38 at a forward end, and a second pointed metal probe 39 including a laterally outwardly extending second flange 40 at a forward end.

The first metal bracket 35 defines a laterally elongated, narrow channel 41. The channel 41 is inclined, having a lateral terminus 42 spaced upwardly of a center terminus 43 (shown in FIG. 5). Similarly, the second metal bracket 36 defines a laterally elongated, narrow channel or opening 45 (shown in FIGS. 5, 6 and 8). The opening 45 is also inclined, having a lateral terminus 46 spaced upwardly of a center terminus 47. Each bracket 35, 36 further defines a pair of lateral apertures or screw holes 49, 50. Screws 51, 52 are inserted through these apertures 49, 50 for affixation to the frame 18.

The first bracket 35 is screwed to a rear portion of the frame 18 with a shank portion of the first probe 37 inserted through the channel 41. The first flange 38 is squeezed in frictional abutment between a rear surface portion 28 of the frame 18 and a forward surface portion (not illustrated) of the first bracket 35.

Figure 7:
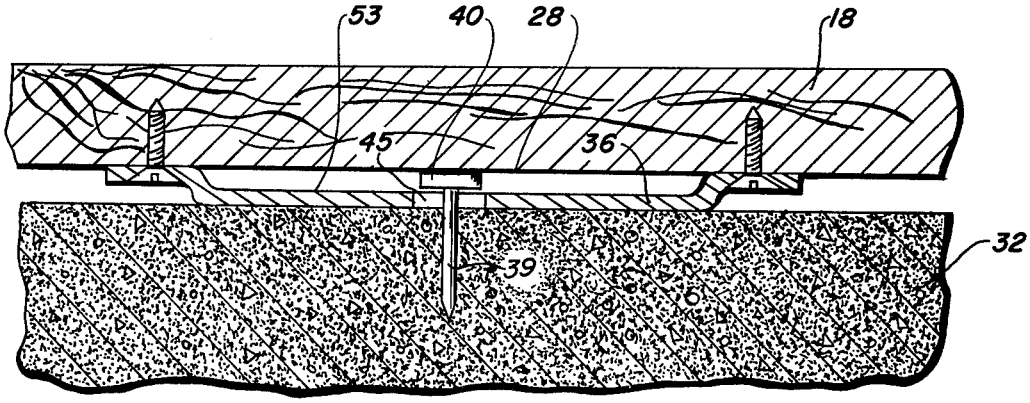
FIG. 7 is a top cross-sectional view taken along the lines 7—7 of FIG. 6.
Figure 8:
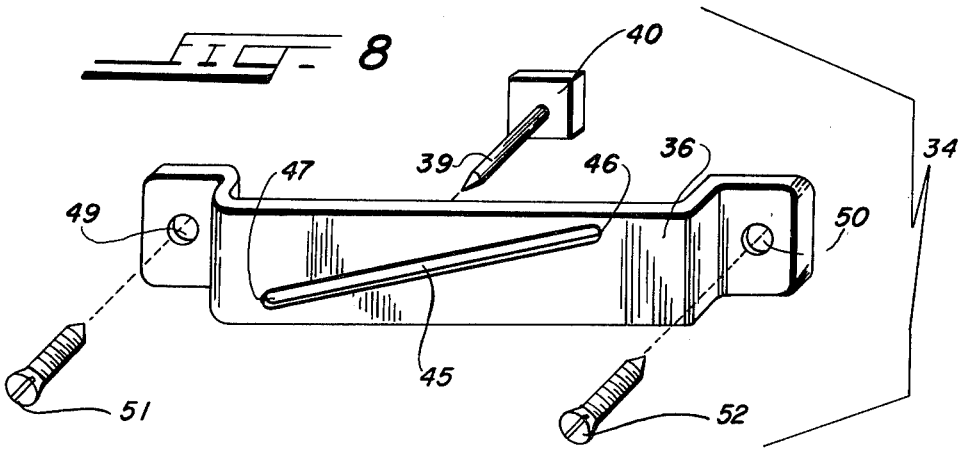
FIG. 8 is an exploded rear perspective view of the hanger of FIGS. 5–7.
Figure 9:
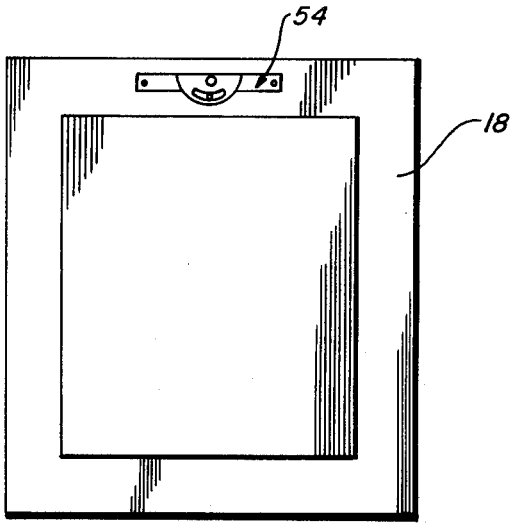
FIG. 9 is a rear elevational view of a picture frame, including a third embodiment of the hanger of the invention.
Figure 10:
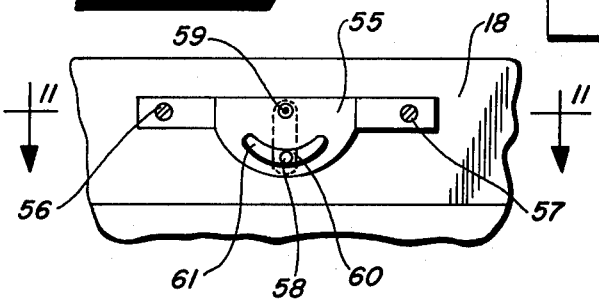
FIG. 10 is an enlarged fragmentary view of the picture frame of FIG. 9, showing the hanger in greater detail.
Figure 11:
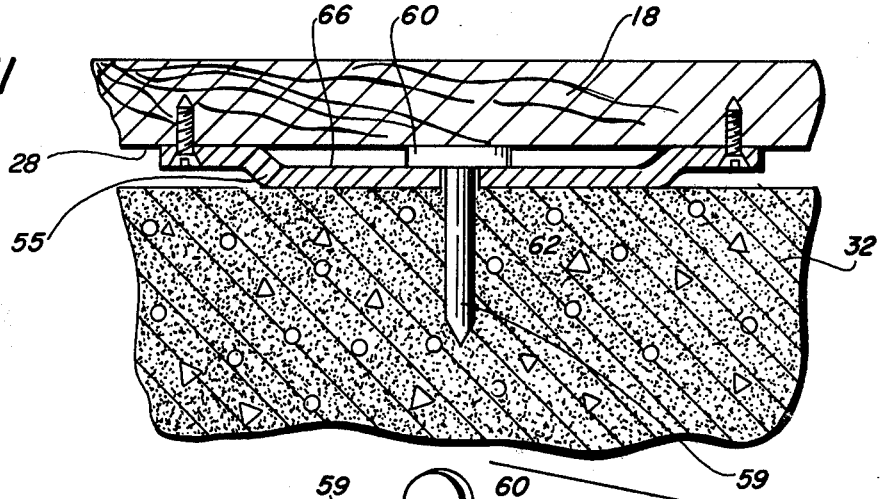
FIG. 11 is a top cross-sectional view, taken along the lines 11—11 of FIG. 10.
Figure 12:
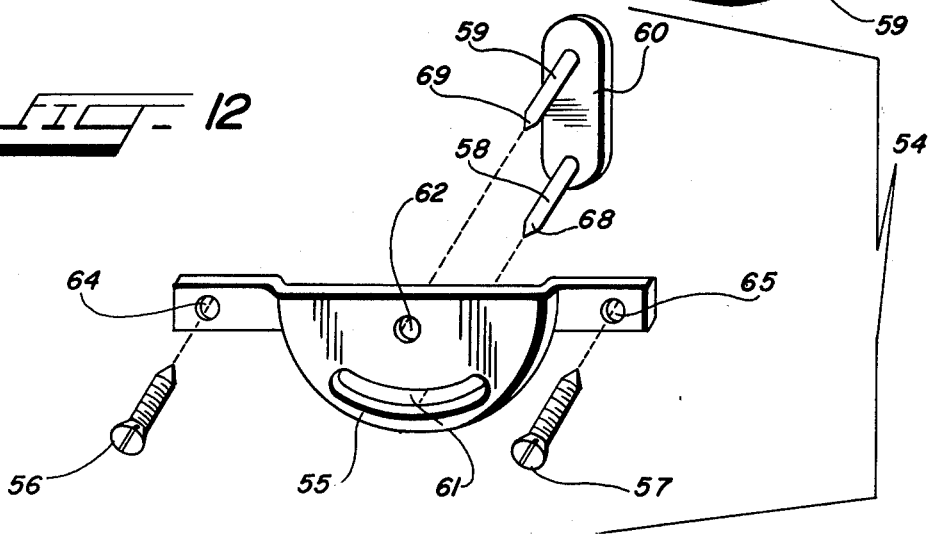
FIG. 12 is an exploded rear perspective view of the hanger of FIGS. 9–11.

The second bracket 36 is screwed to a rear portion of the frame 18 with a shank portion of the second probe 39 inserted through the opening 45. The second flange 40 is squeezed in frictional abutment between a rear surface portion 28 of the frame 18 and a forward surface portion 53 of the second bracket 36, as shown in FIG. 7.

Force is applied to the frame 18 with pointed rearward end portions of the probes or nails 37, 39 facing a wall 32 so that the probes 37, 39 became imbedded in the wall 32. The mode of attachment of the second bracket 36 to the wall 32 is shown in FIG. 7. When both brackets are secured to the wall 32, force applied to the frame 18 adjusts position of the frame to a stable, level attitude. Shank portions of the probes 37, 39 are in positive engagement with lower edge portions of respective brackets 35, 36 facing the channel 41 and opening 45. Frictional contact between the flanges 38, 40 and the frame 18 and brackets 35, 36 further stabilizes the frame against inadvertent shifting.

Because the first bracket 35 is laterally separated from the second bracket 36, this second embodiment 34 is particularly suitable for very wide frames having a breadth of 12 inches or more. Greater stability is provided with a pair of laterally separated brackets than where only a single bracket is used.

A third embodiment of a manually adjustable picture hanger 54 of the invention is shown in FIGS. 9–12. This third embodiment 54 includes bracket means comprising a single generally semicircular metal bracket 55, two screws 56, 57 for securing the bracket 55 to a rear portion of a picture frame 18, and a first pointed probe 58 and a second pointed probe 59 joined together by a bight or flange 60 extending between forward extremities of the probes 58, 59.

The metal bracket 55 defines an arcuate channel 61 and a smaller circular opening 62 spaced upwardly of the channel 61. A center of curvature for the arcuate channel 61 is located in the opening 62. Screws 56, 57 are inserted through screw holes or apertures 64, 65 formed in two lateral wings of the bracket 55.

The bracket 55 is screwed to a rear portion of the frame 18 with a shank portion of the first probe 58 inserted through the channel 61, a shank portion of the second probe 59 inserted through the circular opening 62, and the bight 60 squeezed in frictional abutment between a rear surface portion 28 of the frame 18 and a forward surface portion 66 of the bracket 55.

Pointed rearward end portions 68, 69 of the probes 58, 59 are forced into the wall 32 by applying force to the frame 18. The probes 58, 59 are thereby imbedded in the wall 32. The frame 18 is adjusted to a stable, level attitude by application of rotational force to the frame 18. A shank portion of the first probe 58 is in positive engagement with a lower edge portion of the bracket 35 facing the channel 61. Friction between the bight 60 and frame 18 further stabilizes the frame 18 against inadvertent shifting.

With the foregoing detailed description of my invention in mind, numerous changes and modifications will occur to persons skilled in the art. For example, the brackets shown in the first and second embodiments of FIGS. 1–8 may be inverted without seriously impairing their effectiveness. Other similar alterations can be made in my picture hanger without departing from the spirit and scope of the invention as set forth in the following claims.

What is claimed is:

1. A hanger for attaching a picture frame to a wall and for manually adjusting the position of said frame to a stable level attitude without detaching said frame from said wall, comprising generally flat bracket means defining a first opening and an elongated second opening;

means for affixing said bracket means to a picture frame;

a first probe including a shank extending through said first opening and abutting against an upper edge portion of said bracket means facing said first opening, a first flange extending laterally outwardly of said first probe and including a portion adjacent to and forward of said bracket means in frictional abutment with both said frame and said bracket means, and means for attaching said first probe to a wall;

a second probe including a shank extending through said second opening and abutting frictionally against an upper edge portion of said bracket means facing said second opening, a second flange extending laterally outwardly of said second probe and including a portion adjacent to and forward of said bracket means in frictional abutment with both said frame and said bracket means, and means for attaching said second probe to a wall;

whereby upon affixing said bracket means to a rear portion of said picture frame and attaching said first probe and said second probe to a wall, manual force applied to said picture frame pivots said bracket means about said second probe to adjust said picture frame to a level attitude.

2. The hanger of claim 1, wherein said bracket means comprises a single bracket, and said hanger further comprises a bight extending between said first probe and second probe forwardly of said bracket, said bight being in frictional abutment with both said bracket and said frame to stabilize said picture frame against inadvertent shifting.

3. The hanger of claim 1, wherein said bracket means comprises a single bracket and said second opening is spaced downwardly of said first opening.

4. The hanger of claim 3, wherein said second opening comprises a generally arcuate channel having a center of curvature in said first opening, whereby manual force applied to said picture frame rotates said bracket about said first probe and said second probe to adjust said picture frame to a level attitude.

5. A hanger for attaching a picture frame to a wall and for manually adjusting position of said frame to a stable level attitude without detaching said frame from said wall, comprising (1) a bracket means comprising a first lower edge portion and a second lower edge portion joining said first lower edge portion at a center terminus, said first lower edge portion and said second lower edge portion each defining an inclined support surface extending upwardly and laterally outwardly of said center terminus;

(2) means for affixing said bracket means to a picture frame;

(3) a first probe including (a) a first shank abutting against said first lower edge portion of the bracket, (b) a first flange extending radially outwardly of said first shank and including a portion forward of said bracket means abutting frictionally against said picture frame and said bracket means, and (c) means for attaching said first probe to a wall; and (4) a second probe including (a) a second shank abutting against said second lower edge portion of the bracket, (b) a second flange extending radially outwardly of said second shank and including a portion forward of said bracket means abutting frictionally against said picture frame and said bracket means, and (c) means for attaching said second probe to a wall; whereby upon affixing said bracket means to a rear portion of a picture frame and attaching said first probe and said second probe to a wall, manual force applied to the picture frame pivots said bracket means about said first probe and said second probe to adjust the picture frame to a stable level attitude.

6. The hanger of claim 5, wherein said bracket means comprises a single bracket, and said hanger further comprises (5) a bight extending between said first probe and said second probe to adjoin said first probe with said second probe.

7. The hanger of claim 6, wherein said bracket squeezes said bight in frictional abutment with both said bracket and said frame, thereby to stabilize said frame against inadvertent shifting.

8. The hanger of claim 5, wherein said means for attaching said first probe to a wall and said means for attaching said second probe to a wall each comprise a sharpened point at a rearward end portion thereof.

* * * * *